US010238900B2

(12) United States Patent
Rath et al.

(10) Patent No.: US 10,238,900 B2
(45) Date of Patent: Mar. 26, 2019

(54) AIMING TOOL FOR NOZZLES

(71) Applicant: Caterpillar Inc., Peoria, IL (US)

(72) Inventors: Christian Rath, Peoria, IL (US); Austin Joseph Schmidt, Macedonia, OH (US)

(73) Assignee: Caterpillar Inc., Deerfield, IL (US)

( * ) Notice: Subject to any disclaimer, the term of this patent is extended or adjusted under 35 U.S.C. 154(b) by 53 days.

(21) Appl. No.: 15/262,257

(22) Filed: Sep. 12, 2016

(65) Prior Publication Data

US 2016/0375456 A1 Dec. 29, 2016

(51) Int. Cl.

| | |
|---|---|
| ***A62C 3/00*** | (2006.01) |
| ***A62C 3/07*** | (2006.01) |
| ***A62C 31/28*** | (2006.01) |
| *A62C 99/00* | (2010.01) |

(52) U.S. Cl.

CPC ..... *A62C 3/07* (2013.01); *A62C 31/28* (2013.01); *A62C 99/009* (2013.01)

(58) Field of Classification Search

CPC ..... A62C 3/07; A62C 31/38; A62C 99/009; F21Y 2115/10; A61L 2209/12; F21W 2121/00; F21V 33/00

USPC ..... 42/116, 117; 362/96

See application file for complete search history.

(56) References Cited

U.S. PATENT DOCUMENTS

| | | | | |
|---|---|---|---|---|
| 7,021,994 | B2 | 4/2006 | Ahti | |
| 7,966,753 | B2 | 6/2011 | Vanneman et al. | |
| 8,132,354 | B1 * | 3/2012 | Sellers | F41G 1/54 42/116 |
| 8,256,153 | B1 * | 9/2012 | Noha | F41G 1/35 362/110 |
| 2010/0012751 | A1 * | 1/2010 | Warren | B05B 1/00 239/289 |

FOREIGN PATENT DOCUMENTS

| | | |
|---|---|---|
| CA | 2012483 | 8/1990 |
| CN | 201974972 | 9/2011 |
| CN | 103272353 | 9/2013 |
| KR | 20040085878 | 10/2004 |
| KR | 20090129000 | 12/2009 |
| WO | 2013102213 | 7/2013 |
| WO | 2015092692 | 6/2015 |

* cited by examiner

*Primary Examiner* — Viet Le
(74) *Attorney, Agent, or Firm* — Steve M. Hanley

(57) ABSTRACT

A tool for aiming a nozzle assembly having a fluid outlet and a cap is provided. The tool includes a housing defining a bore. The bore has a side wall radially disposed about an axis. The tool also includes a laser assembly including a laser emission source configured to produce a light beam collinear with the axis of the housing. The laser assembly also includes a power supply. The tool further includes at least one of a switch and an electrical contact provided within the housing and adapted to be in electrical communication with the power supply and the laser emission source based on a contact with the nozzle assembly. The tool is installed on the nozzle assembly such that the bore is adapted for placement about an outer surface of the nozzle assembly so that the fluid outlet is substantially concentric about the axis.

4 Claims, 4 Drawing Sheets

AIMING TOOL FOR NOZZLES

TECHNICAL FIELD

The present disclosure relates generally to a tool, and more particularly, to the tool for assisting in aiming of nozzles.

BACKGROUND

Machines, such as tractors, have a fire suppression system installed onboard the machine. These fire suppression systems include nozzles that are operated to eject a fire suppressant fluid when required. The nozzles of the fire suppression system are placed at different locations on the machine, for example, near a radiator, below an operator cabin, and so on. The nozzles are fixedly attached at these specific locations to eject the fire suppressant fluid within a predetermined radius of a fixed target location.

Aiming of the nozzles to ensure that the fire suppressant fluid is ejected onto the target locations is a cumbersome, tedious, and costly procedure. Existing solutions include providing a laser aiming system in connection with the nozzle to aim the nozzle more accurately at the target location. However, such systems may be difficult to install and uninstall from the nozzle since a cap that is fitted onto the nozzle first needs to be removed, after which the laser aiming system is installed onto the nozzle. Further, after alignment of the nozzle, the laser aiming system is removed and the cap is replaced onto the nozzle. Since there are a number of these nozzles mounted on the machine, the removal and reattachment of the caps to each of the nozzles may be a tedious process requiring a lot of effort. Also, in some situations, the laser aiming system is threadably coupled to the nozzle, which may make the installation and removal process thereof difficult and time consuming.

U.S. Published Application Number 2010/0012751 describes a laser assisted aiming system for use in directing the flow of a nozzle discharging a fluid stream. The aiming system includes a laser module adapted to emit a light beam that is substantially concentric with the stream of fluid discharged from the discharge tip.

SUMMARY OF THE DISCLOSURE

In one aspect of the present disclosure, a tool for aiming a nozzle assembly having a fluid outlet and a cap is provided. The tool includes a housing defining a bore. The bore has a side wall radially disposed about an axis. The tool also includes a laser assembly disposed within the housing. The laser assembly includes a laser emission source configured to produce a light beam collinear with the axis of the housing. The laser assembly also includes a power supply. The tool further includes at least one of a switch and an electrical contact provided within the housing and adapted to be in electrical communication with the power supply and the laser emission source based on a contact with the nozzle assembly. The tool is installed on the nozzle assembly such that the bore is adapted for placement about an outer surface of the nozzle assembly so that the fluid outlet is substantially concentric about the axis.

Other features and aspects of this disclosure will be apparent from the following description and the accompanying drawings.

DETAILED DESCRIPTION

Wherever possible, the same reference numbers will be used throughout the drawings to refer to the same or the like parts. Also, corresponding or similar reference numbers will be used throughout the drawings to refer to the same or corresponding parts.

Figure 1:
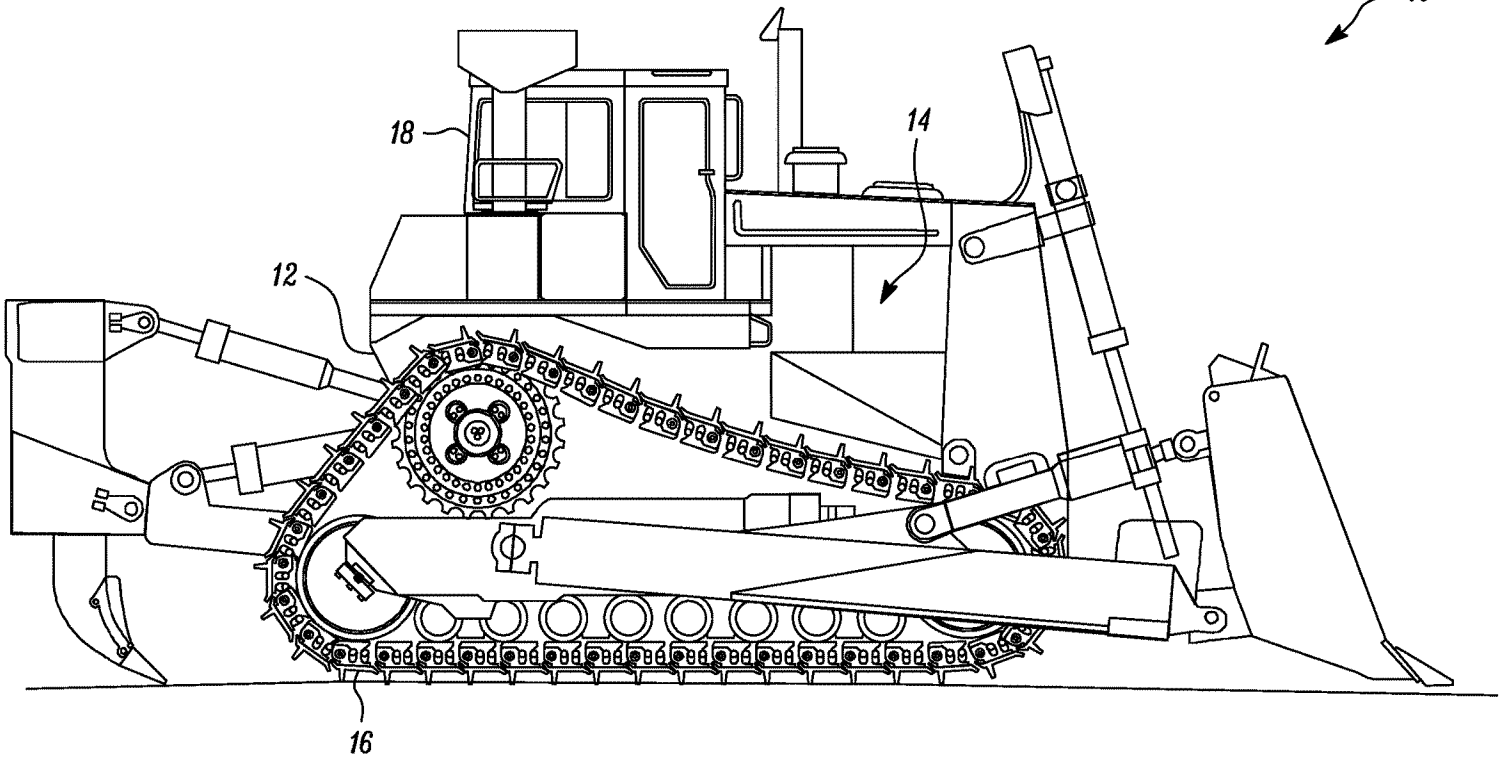
FIG. 1 is a side view of an exemplary machine, according to one embodiment of the present disclosure.

FIG. 1 illustrates an exemplary machine 10. More specifically, the machine 10 is shown as a track type tractor. It should be understood that the machine 10 may alternatively include other machines such as, a motor grader, a track loader, a wheel loader, a compactor, an excavator, a large mining truck, or any other agricultural, mining or construction machinery.

Referring to FIG. 1, the machine 10 includes a chassis or a frame 12. An engine enclosure 14 houses a power source (not shown) to provide power to the machine 10. The power source may include one or more engines, power plants or other power delivery systems like batteries, hybrid engines, and the like. A set of ground engaging members 16 including tracks are provided on the machine 10 for the purpose of mobility. Alternatively, the machine 10 may include wheels or rollers. Further, the machine 10 includes an operator cabin 18 which houses controls for operating the machine 10.

The machine 10 also includes a fire suppression system (not shown). The fire suppression system includes a number of nozzle assemblies 20 (see FIG. 2) that are installed at different locations on the machine 10 for discharge of a fire suppressant fluid therefrom. For example, the nozzle assemblies 20 are located beneath the operator cabin 18 of the machine 10. In another example, the nozzle assemblies 20 are located proximate to a radiator (not shown) of the machine 10. In yet another example, the nozzle assemblies 20 are located underneath a hood (not shown) and/or above a fender (not shown) of the machine 10. Alternatively, the nozzle assemblies 20 may be present at various other locations on the machine 10 without any limitation.

Figure 2:
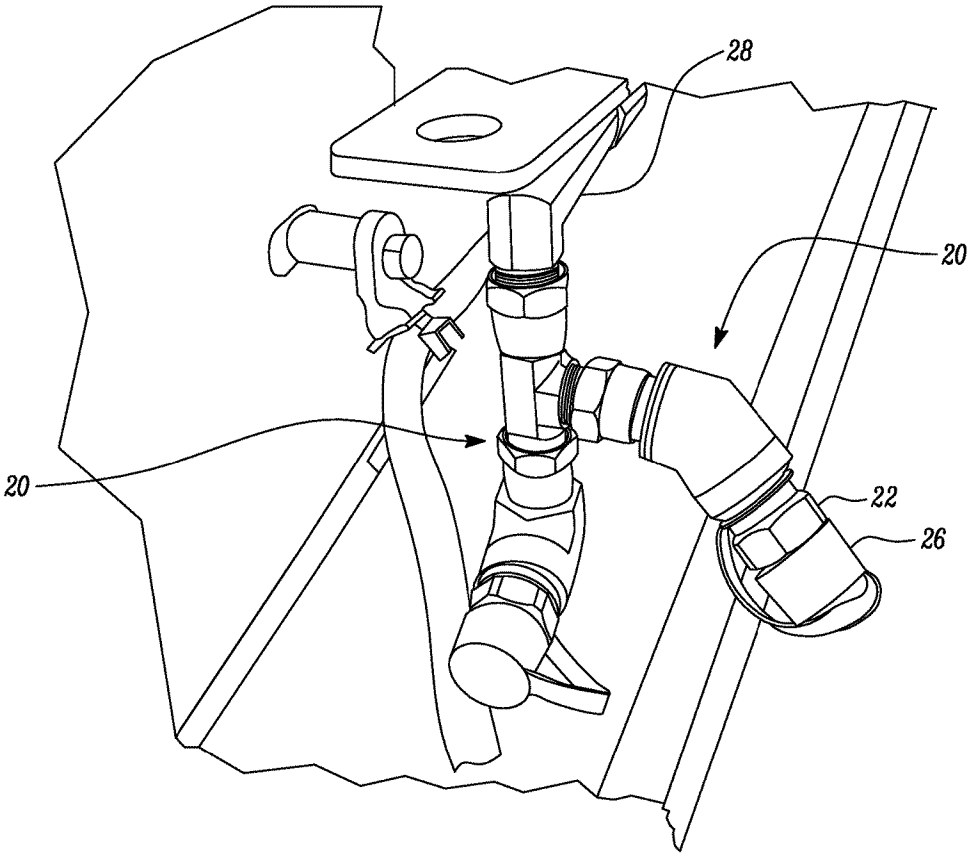
FIG. 2 is a perspective view of a portion of the machine of FIG. 1 including a nozzle assembly as part of a fire suppression system of the machine, according to one embodiment of the present disclosure.

Referring to FIG. 2, an exemplary nozzle assembly 20 is shown attached to a portion of a frame 12 (see FIG. 1) of the machine 10. The nozzle assembly 20 includes a head portion 22, a fluid outlet 24 (see FIG. 4), and a cap 26. The head portion 22 of the nozzle assembly 20 has a generally hexagonal shape and is made of metal. The cap 26 is used to block the fluid outlet 24. The cap 26 may be made of plastic.

In the accompanying figures, two nozzle assemblies 20 are shown. However, the number of nozzles and the design and construction of the nozzle assembly 20 may vary based on the system requirements. Further, the nozzle assemblies 20 are coupled to the machine 10 using any known coupling mechanism in the art. Each of the nozzle assemblies 20 are positioned so as to direct the fire suppressant fluid that will be ejected through the fluid outlet 24 thereof in a predetermined direction at a fixed target location. Accordingly, the nozzle assembly 20 is attached to a connection assembly 28. The connection assembly 28 includes suitable mechanical fasteners, for example nut and bolts, that can be tightened or loosened to correspondingly adjust and align the nozzle assembly 20 attached thereto.

Figure 3:
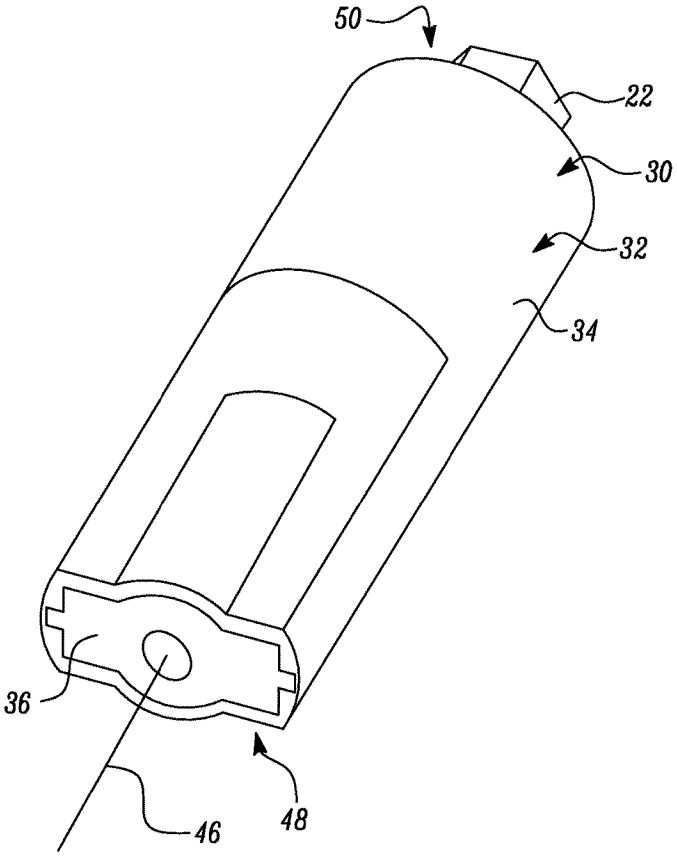
FIG. 3 is a perspective view of an aiming tool attached to the nozzle system of FIG. 2, according to one embodiment of the present disclosure.
Figure 4:
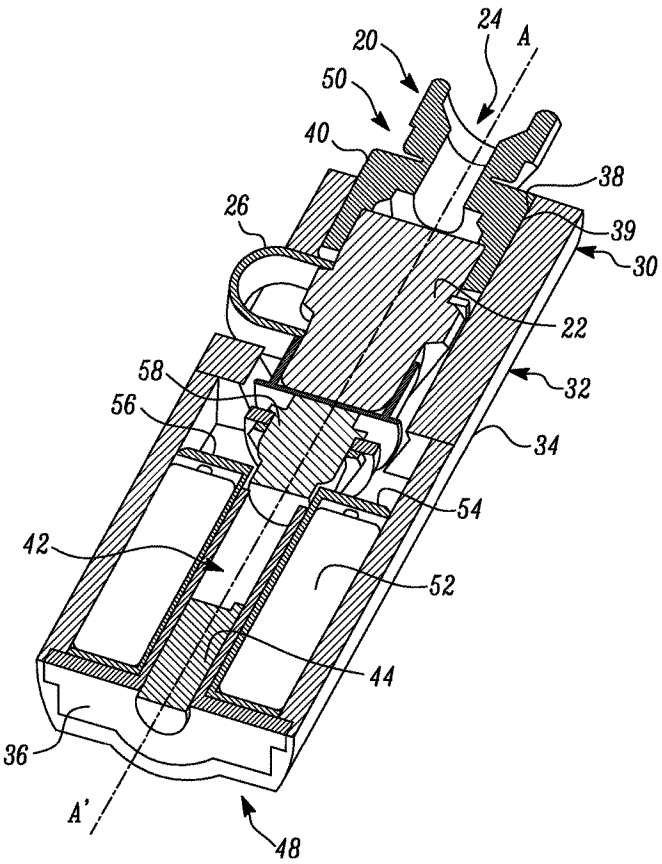
FIG. 4 is a sectional view of the aiming tool and the nozzle system, according to one embodiment of the present disclosure.

The present disclosure relates to a tool 30 (see FIG. 3) for the nozzle assembly 20. The tool 30 assists in aiming of the nozzle assembly 20. Referring to FIGS. 3 and 4, the tool 30 can be installed on the nozzle assembly 20 during an alignment of the nozzle assembly 20 to ensure that the nozzle assembly 20 is directed at the desired target location.

During installation, the tool 30 is pressed onto the head portion 22, the fluid outlet 24, and the cap 26 of the nozzle assembly 20. Some portions of the tool 30 may be manufactured using three dimensional printing or other known manufacturing processes. The tool 30 includes a housing 32. The housing 32 may be manufactured using three dimensional printing. The housing 32 may be made of plastic, polymer, or any other suitable material. The housing 32 is a two piece assembly including an outer shell 34 and an inner shell 36. The housing 32 defines a bore 38 and an axis A-A'. In order to align the nozzle assembly 20, the housing 32 is press fitted onto the nozzle assembly 20 such that the cap 26 and the head portion 22 of the nozzle assembly 20 are received into the bore 38. A side wall 39 of the bore 38 radially surrounds an outer surface 40 of the nozzle assembly 20. Moreover, the fluid outlet 24 of the nozzle assembly 20 is concentric about the axis A-A' of the housing 32. The housing 32 encloses the head portion 22 of the nozzle assembly 20 and a length of the housing 32 is such that the housing 32 extends along the axis A-A'.

Further, the housing 32 includes a laser assembly 42 provided therein. The laser assembly 42 includes a laser emission source 44 that is configured to produce a laser beam 46 collinear with the axis A-A'. In one example, the laser emission source 44 is a laser diode. The laser emission source 44 is positioned within the inner shell 36 of the housing 32. The laser beam 46 emerges from an end 48 of the housing 32 that is opposite to another end 50 at which the nozzle assembly 20 is inserted. The laser beam 46 is used to aim at the desired target location that the nozzle assembly 20 is desired to point at.

The laser assembly 42 also includes a power source 52. The power source 52 includes two batteries, such as a Lithium ion battery, or any other suitable power source. In the accompanying figures, the housing 32 includes a first compartment 54 and a second compartment 56 disposed in a spaced apart arrangement for holding the batteries in place within the housing 32.

The housing 32 also includes a switch 58. The switch 58 is embodied as a contact switch, such that the switch is activated when the nozzle assembly 20 comes in contact with the switch 58. This takes place when the nozzle assembly 20 is inserted into the housing 32 during the installation of the tool 30 thereon. The activation of the switch 58 causes the laser emission source 44 to be energized for producing the laser beam 46. Accordingly, the switch 58 is positioned within the housing 32 at a location along the axis A-A' which may come in contact with the cap 26 of the nozzle assembly 20 when inserted into the housing 32. The switch 58 is in electrical communication with the power source 52 and the laser emission source 44.

In another embodiment, the housing 32 includes electrical contacts (not shown) positioned within the housing 32. In one example, two electrical contacts may be provided within the housing 32, such that the electrical contacts may come in contact with the head portion 22 of the nozzle assembly 20. The electrical contacts may be in electrical communication with the laser assembly 42. When the head portion 22 of the nozzle assembly 20 is introduced within the housing 32, an electrical circuit of the laser assembly 42 is completed, causing the activation of the laser emission source 44 to produce the laser beam 46.

During a calibration process, the tool 30 is initially installed onto the nozzle assembly 20. Due to the contact of the nozzle assembly 20 with the switch 58 or the electrical contacts within the housing 32, the laser emission source 44 is triggered to produce the laser beam 46. If the laser beam 46 points at the desired location and/or within a desired radius thereof, then this indicates that the nozzle assembly 20 is correctly aligned with respect to the desired target location. Accordingly, the tool 30 may be uninstalled from the nozzle assembly 20.

However, if the tool 30 does not point at the desired location and/or within the desired radius, this indicates that the nozzle assembly 20 requires adjustment. The nozzle assembly 20 may be manually readjusted by suitable tightening and/or loosening of the nuts and bolts of the connection assembly 28 to counter an offset of the laser beam 46 from the desired location. After the nozzle assembly 20 is readjusted such that the laser beam 46 points at the desired target location, indicating the nozzle assembly 20 is correctly aligned, the tool 30 may be uninstalled from the nozzle assembly 20. A person of ordinary skill in the art will appreciate that the internal design, layout, and construction of the tool 30 is exemplary and does not limit the scope of the present disclosure.

INDUSTRIAL APPLICABILITY

The tool 30 of the present disclosure allows for a quick and easy solution to accurately aim the nozzle assembly 20 at the desired target location. The tool 30 can be easily press fitted onto the nozzle assembly 20 while the cap 26 of the nozzle assembly 20 remains installed thereon. An activation mechanism for the laser emission source 44, which is the switch 58 and/or the electrical contact, of the laser assembly 42 is positioned within the housing 32 and is triggered based on the contact with the nozzle assembly 20. Hence, the laser assembly 42 is turned off or deactivated when not in contact with the nozzle assembly 20, preventing the tool 30 from producing the laser beam 46 to avoid any unintentional usage.

The housing 32 of the tool 30 may be manufactured using three dimensional printing such that the design of the housing 32 may be suitably modified so that the housing 32 may be utilized on various types of machines having their own nozzle assembly construction. The tool 30 may be used on a periodic basis to initially align the nozzle assembly 20 and/or for subsequent re-alignment of the nozzle assembly 20 as and when required. The tool 30 provides a cost effective, efficient, and easy to use solution that saves on time and effort of service personnel in charge of alignment of the nozzle assemblies 20.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. An alignment assembly, comprising:

a tool comprising a housing having an internal surface that defines a bore therethrough, the bore extending from a first aperture at a first end of the housing to a second aperture at a second end of the housing;

a laser assembly disposed within the bore of the housing, the laser assembly including:

a laser emission source configured and arranged to produce a light beam that projects through the first aperture of the housing, and a power supply; and a switch disposed entirely within the bore of the housing between the laser emission source and the second aperture, the switch being configured to effect selective electrical communication between the power supply and the laser emission source; and a nozzle assembly disposed within the bore of the housing between the switch and the second aperture, the nozzle assembly bearing on the switch, thereby energizing the laser emission source by effecting electrical communication between the power supply and the laser emission source via the switch.

2. The alignment assembly of claim 1, wherein the tool is configured such that removal of the nozzle assembly from the tool opens the switch, thereby de-energizing the laser emission source by blocking electrical communication between the power supply and the laser emission source.

3. The alignment assembly of claim 1, wherein a fluid outlet head of the nozzle assembly is disposed within the bore.

4. The alignment assembly of claim 2, wherein a fluid outlet head of the nozzle assembly is disposed within the bore.

* * * * *